US005860552A

United States Patent [19]

Culhane et al.

[11] Patent Number: 5,860,552

[45] Date of Patent: Jan. 19, 1999

[54] SELF RIGHTING LIQUID CONTAINER

[75] Inventors: William J. Culhane, Wyoming; Randall H. Strange, Lebanon, both of Ohio

[73] Assignee: International Paper Company, Purchase, N.Y.

[21] Appl. No.: 966,588

[22] Filed: Nov. 10, 1997

[51] Int. Cl.[6] ..... B65D 41/56

[52] U.S. Cl. ..... 220/212; 220/694; 220/709; 220/792; 220/793; 220/367.1; 220/631

[58] Field of Search ..... 220/212, 694, 220/703, 780, 792, 793, 631, 709, 367.1

[56] References Cited

U.S. PATENT DOCUMENTS 2,456,989 12/1948 Polcyn .
2,554,018 5/1951 Despres ..... 220/377 X
2,815,161 12/1957 Kramer .
2,861,716 11/1958 Kramer .
3,156,941 11/1964 Tomaiuolo ..... 220/212 X
3,800,999 4/1974 Serritella .
4,055,273 10/1977 Jones .
4,624,384 11/1986 Ko .
4,917,258 4/1990 Boyd et al. ..... 220/212 X

*Primary Examiner*—Stephen K. Cronin
*Attorney, Agent, or Firm*—Ralph J Skinkiss

[57] ABSTRACT

An anti-spill liquid container is disclosed and taught wherein the center of gravity of the container/liquid combination causes the container to inherently roll to a predetermined, non-spill, position if the container is inadvertently "knocked over." The invention disclosed and taught is applicable to any generally cylindrical container and is particularly suitable for drinking cups as commonly used in the fast food industry.

27 Claims, 6 Drawing Sheets

SELF RIGHTING LIQUID CONTAINER

BACKGROUND OF THE INVENTION

The present invention relates to liquid containers generally having a cylindrical configuration. More specifically the invention taught herein relates to a means for orienting such containers to a desired rotational position, by the dynamic action of the fluid therein, when the container is inadvertently upset from its normal upright position.

Although the invention disclosed and taught herein is particularly suitable for application to drinking cups typically used in the fast food industry, and the preferred embodiment as disclosed, herein below, teaches the invention in the form of such a drinking cup, one skilled in the art can readily apply the herein invention to containers used in other industries such as chemical transporting barrels or drums typically used in the chemical industry and other similar industrial and/or household applications.

SUMMARY OF THE INVENTION

It is an object of the present invention to provide self righting container suitable for use in the transport of various liquids typically used in industrial and/or household applications and particularly suitable for beverage drinking cups as typically used in the fast food industry.

In the preferred embodiment of the present invention a generally cylindrical container is provided with a removable top cover or lid having an eccentric roll flange circumscribing the lid whereby the center of gravity of the liquid, inside the container, inherently imposes a rolling moment upon the container if the container is inadvertently "tipped-over." The rolling moment is programmed, by the peripheral configuration of the roll flange, to inherently roll the container to a desired angular position, about the containers longitudinal axis, whereby an axially offset opening in the top cover may be positioned at the top of the container thereby preventing spillage of the liquid contents therefrom. Alternatively, for containers not having a removable top cover or lid, the roll flange may be integrated directly into the top rim or surface of the container.

DETAILED DESCRIPTION OF THE INVENTION

Figure 1:
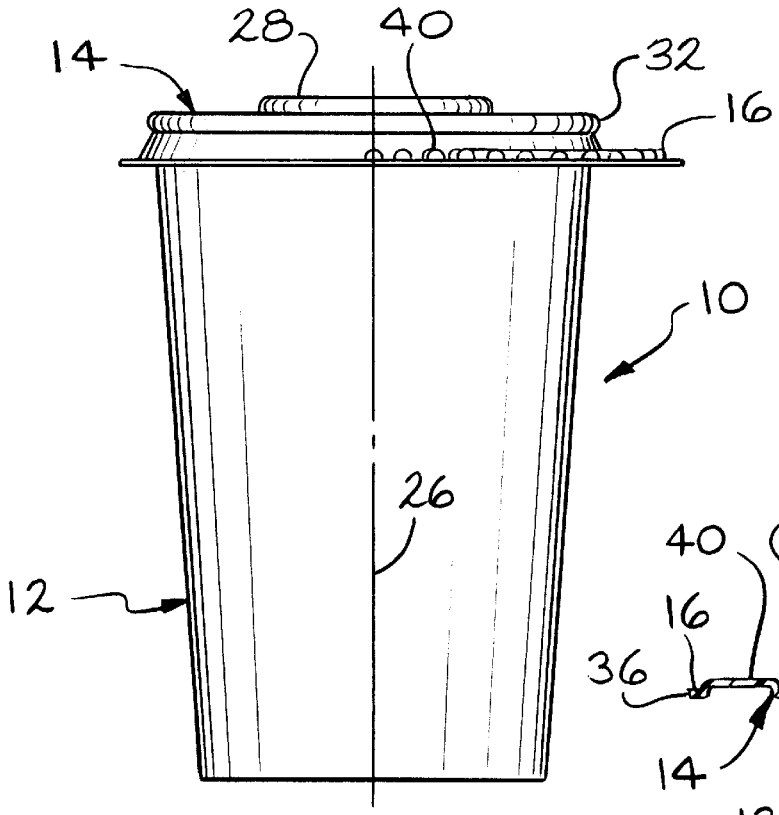
FIG. 1 presents a side elevational view of a typical fast food drinking cup embodying the present invention.
Figure 6:
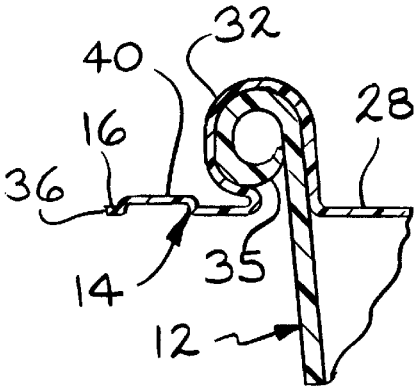
FIG. 6 is a cross section view taken along line 6—6 in FIG. 2 showing the preferred manner of attaching the cup lid to the cup bead.
Figure 2:
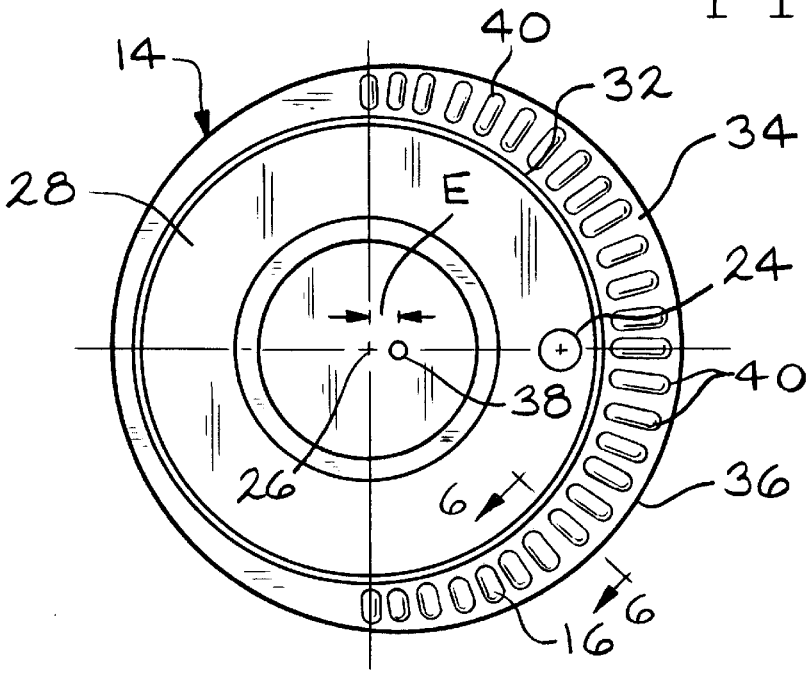
FIG. 2 presents a top plan view of the drinking cup illustrated in FIG. 1.

FIGS. 1 and 2 illustrate a typical drinking cup assembly 10, of the paper, plastic, or plastic foam variety, embodying the present invention. Cup assembly 10 is fitted with a removable lid 14 as typically used in the fast food industry, or any other suitable top covering device. Since the technology by which such lids are attached to such cups in the fast food industry is well known and since lid 14 may embody any of the lid attaching configurations that may be found in the fast food, or any other applicable industry, the means by which such lids are affixed to the cup need not be specifically addressed herein. However, it is preferable for rim 32, of lid 14, to be firmly attached to bead 35 of cup 12, as illustrated in FIG. 6, to prevent the lid from inadvertently "popping-off" when the cup is upset. Further it is preferable that the disc of dome 28, inside cup 12, be positioned approximately opposite roll flange 14, as illustrated in FIG. 6, thereby reinforcing bead 35 to assure that the circular configuration of the bead is not distorted upon upset of the cup assembly.

Figure 9:
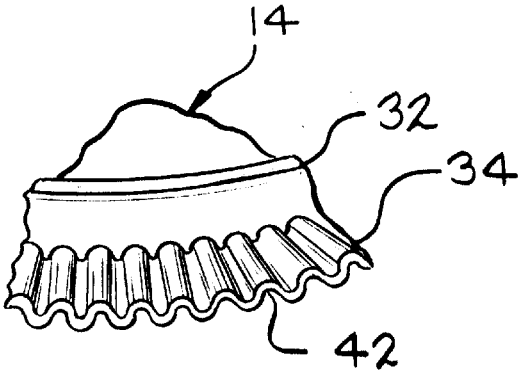
FIG. 9 presents an alternate embodiment of the roll flange wherein the flange is provided with a scalloped or fluted configuration to structurally rigidify the flange.

Cup 12, preferably, has an axis of rotation 26 about which the truncated cone, or cylindrical, configuration is symmetric. The main body 28 of lid 14, including cup sealing rim 32 is also symmetrical about axis 26 as illustrated in FIGS. 1 and 2. However, circumscribing sealing rim 32, of lid 14, is a, preferably circular, radially extending, roll flange 34 having a generally circular peripheral edge 36 which is symetrical about center 38. Center 38 of roll flange 34 is offset from cup axis 26 by a distance "E" whereby the sealing rim 32 and the periphery 36 of flange 34 are configured as two eccentric circles. Radially extending reinforcing ribs 40 are preferable to provide structural reinforcement of flange 34; alternatively the thickness of flange 34 might be increased to provide flange structural rigidity. A further alternate embodiment of roll flange 34 may include laterally extending flutes 42, as illustrated in FIG. 9, to strengthen the roll flange against flexing when cup assembly 10 is inadvertently tipped over.

A fluid discharge opening 24 is provide through the dome portion 28 of lid 14, as illustrated in FIG. 2, for the insertion of a drinking straw as typically found in the fast food industry. It is to be understood that in place of a straw insertion hole 24 any other opening may be provided, in lieu thereof, through which the consumer may remove the liquid contents from within cup assembly 10.

Figure 3:
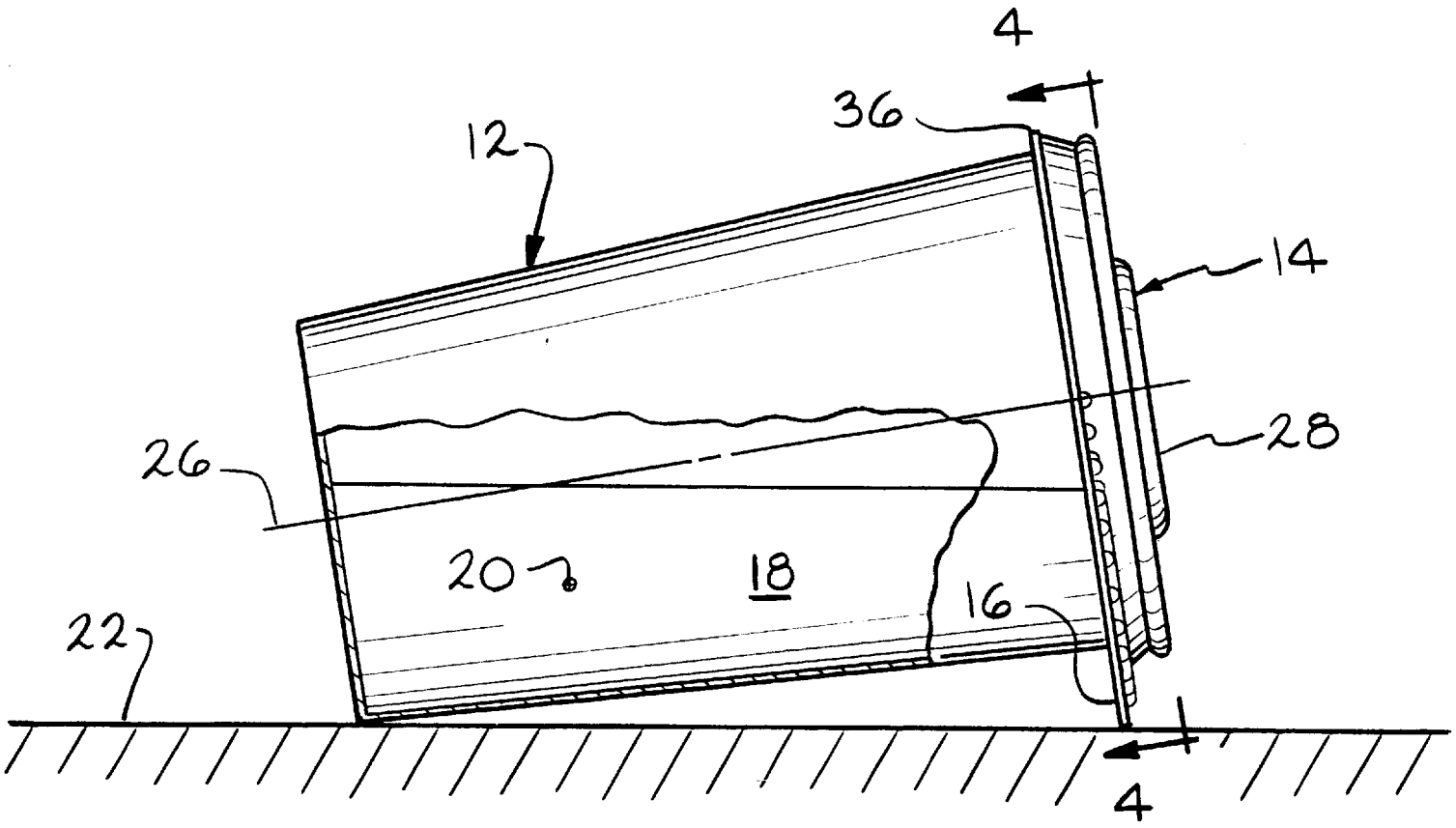
FIG. 3 presents a side view of a drinking cup, as illustrated in FIG. 1, with the cup lying an its side and showing the liquid distribution within the cup and the liquid's center of gravity.

Referring now to FIG. 3, cup 12 and its associated lid 14, are shown in a prone position as if the cup had been inadvertently upset, or "knocked-over." A portion of cup 12 is cut away to show the liquid therein. For convience of explanation cup 12 is illustrated wherein the straw hole, or opening, 24 is at its bottom most position (see FIG. 4A). In the prone position as illustrated in FIG. 3, the liquid 18 within the cup will generally assume the position as shown. Thus the resulting center of gravity 20 of the spilled cup assembly 10 and liquid 18 therein will generally be located as illustrated in FIG. 3.

Figure 4B:
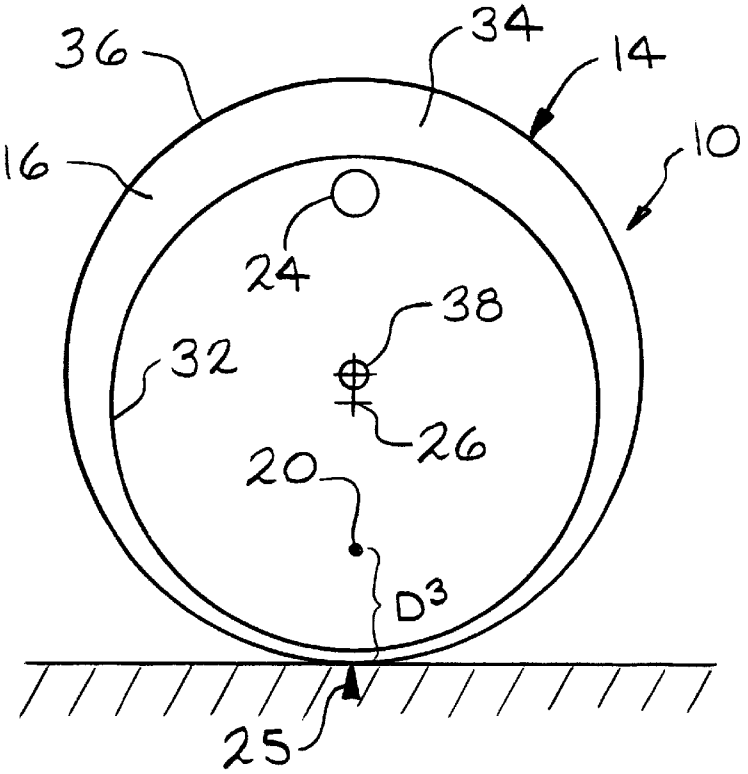
FIG. 4B presents a schematical cross sectional view, similar the that of FIG. 4A however the cup is shown as have rollingly rotated 180 degrees from that of FIG. 4A by action the present invention.
Figure 4A:
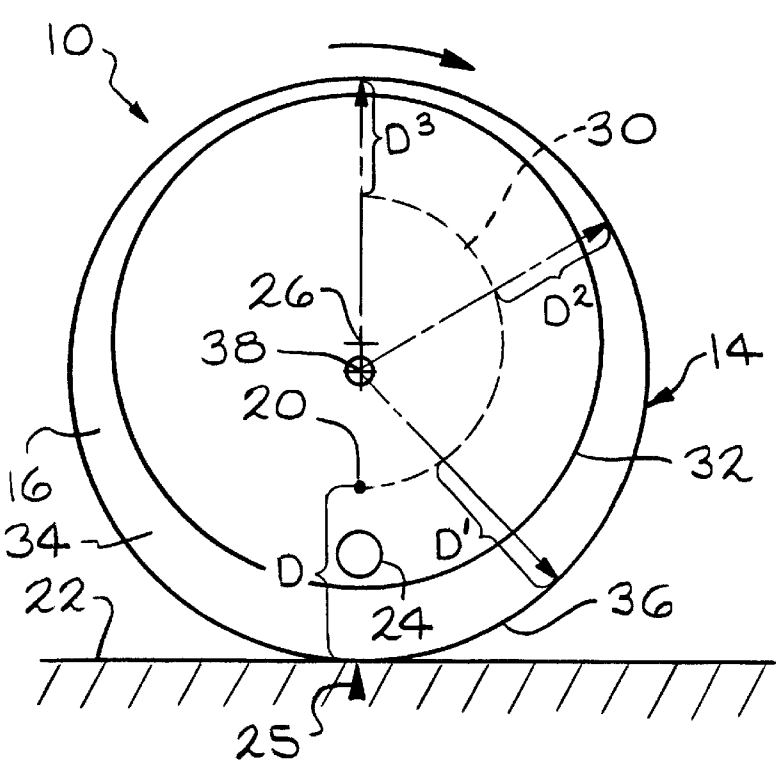
FIG. 4A presents a schematical cross sectional view taken along line 4—4 of FIG. 3.

Now referring to FIGS. 4A and 4B the center of gravity 20 is illustrated at is greatest possible distance, or height, "D" from the surface 22 and above fulcrum 25 because of the presence of the eccentric roll flange 34. Thus the cup and liquid therein represent a state of dynamic instability whereby the center of gravity 20 will inherently seek a condition of absolute dynamic stability as illustrated in FIG. 4B wherein the center of gravity 20 is at its lowest possible (6 o'clock) position.

Because of the eccentricity of roll flange 34, about the cup axis of symmetry 26, a moment, having the lever arm D, is created about fulcrum 25 whereby cup assembly 10 will inherently roll upon the roll flange periphery 36 thereby seeking a more stable, or neutral, configuration. As cup assembly 10 rolls upon roll flange 34 the distance D between the center of gravity 20 and the surface 22 becomes smaller, as illustrated in FIG. 4A by dimension $D^1$, $D^2$, and $D^3$ between the locus 30 of center of gravity 20 and the periphery 36 of roll flange 34, until the center of gravity 20 finds its position of absolute stability, at $D^3$ as illustrated in FIG. 4B.

Thus the drinking cup assembly 10, as taught herein above, is caused to inherently roll to a given position, when inadvertently "knocked-over," whereby the straw hole 24, or any other opening used by the consumer to remove the contents therein, will inherently assume the uppermost (12 o'clock) position, as illustrated in FIG. 4B, thereby preventing spilling of the liquid contents from therein.

Figure 5A:
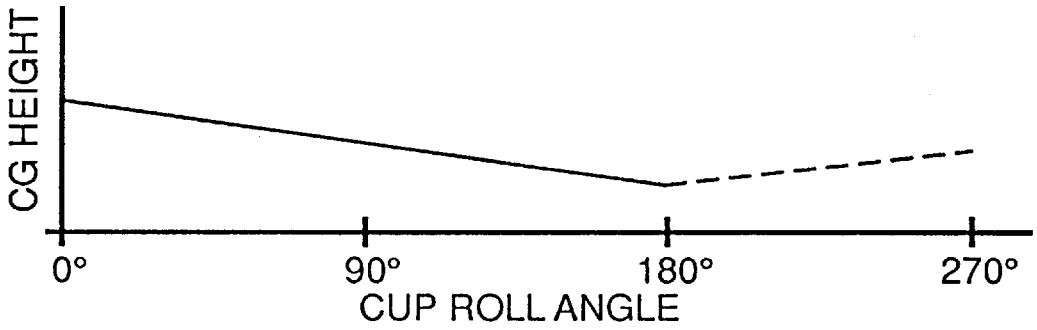
FIG. 5A presents a graph showing the height of the liquid's center of gravity, above a flat surface, versus the roll angle, of the cup, for a cup embodying the herein invention as illustrated in FIGS. 1 and 2.

FIG. 5A presents a plot of the center of gravity height (height D of the center of gravity above the surface 22 in FIG. 4) versus the roll angle of cup assembly 10. As cup assembly 10 rolls from the unstable 0 degree position, as illustrated in FIG. 4A, through the 90 degree position and on to the stable 180 degree position, as illustrated FIG. 4B, the height of center of gravity 20 is seen to steadily decrease in an approximate straight line having a negative slope. In order for the cup to roll beyond the 180 degree position the center of gravity 20 would have to necessarily rise further above the surface 22, as indicated by the broken line, which it can not do without an external force being applied. Thus cup assembly 10 has inherently rolled to and assumed a dynamically stable position whereby the opening 24 is elevated as far above the surface 22 as possible and will not move therefrom without application of an external force.

Figure 5B:
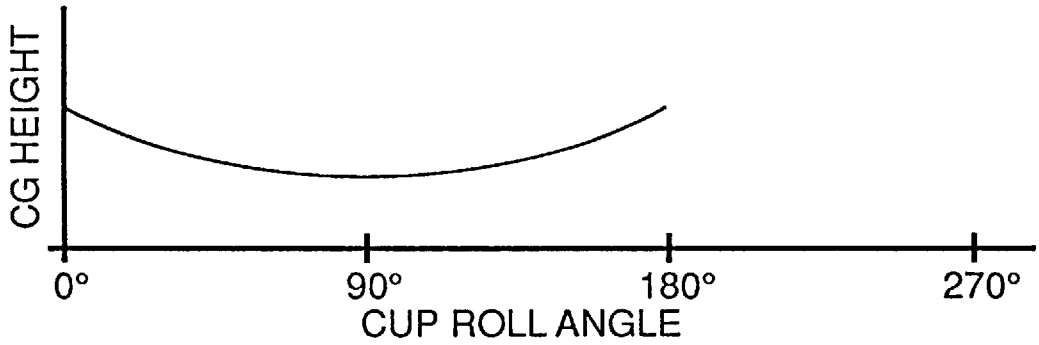
FIG. 5B presents a graph, similar to that of FIG. 5A wherein the roll flange circumscribing the cup lid has an elliptical configuration.

FIG. 5B illustrates the center of gravity height versus roll angle for a cup having an elliptical rim configuration. As seen in FIG. 5B a cup, with an elliptical roll flange would roll to the 90 degree position and no further since to roll beyond the 90 degree position the center of gravity 20 would have to begin rising further above the surface 22. Thus use of an elliptical rim configuration will only reposition opening 24 from the six o'clock position, as viewed in FIG. 4A, to the three, or nine, o'clock position and not the desired 12 o'clock position as with the eccentric circle configuration as illustrated in FIGS. 1 through 4.

In order for center of gravity 20 to impose and maintain a rolling moment upon cup assembly 10 it is necessary that the slope of the center of gravity height versus roll angle curve have a negative slope at all points thereon from the 0 degree position to the 180 degree position. In other words the distance from the center of gravity 20 to the roll flange periphery 36 must continually decrease as a function of roll angle throughout 180 degrees of roll. Thus a roll flange 34 having a periphery 36 other than a circular configuration, as illustrated in FIGS. 1 through 4, may be developed so long as the negative slope is maintained along the center of gravity height vs. roll angle curve.

Figure 5C:
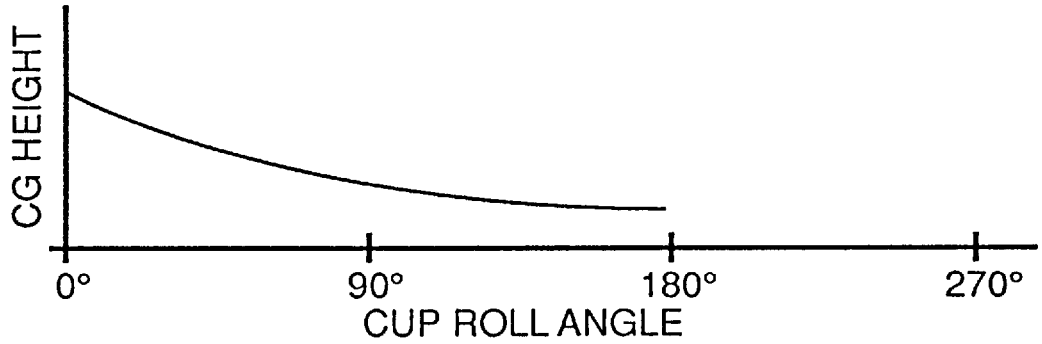
FIG. 5C presents a graph, similar to that of FIGS. 5A and 5B wherein the roll flange circumscribing the cup lid has a programmed configuration whereby, the slope of the curve, as presented in FIG. 5C, at any point thereon, is negative.

Therefore a roll flange may be developed whereby the negative slope of the center of gravity height vs. roll angle curve is greatest at the 0 degree position with a programmed decrease in the curve's slope as the 180 degree position is approached. Thus a greater center of gravity induced roll moment may be provided for the condition where the opening 24 is at its lowest position (six o'clock) whereby the loss of liquid from the cup is greatest, and thereby providing a faster roll response to reposition the opening 24 to the 12 o'clock position. FIG. 5C presents such a center of gravity height vs. roll angle curve.

Figure 7:
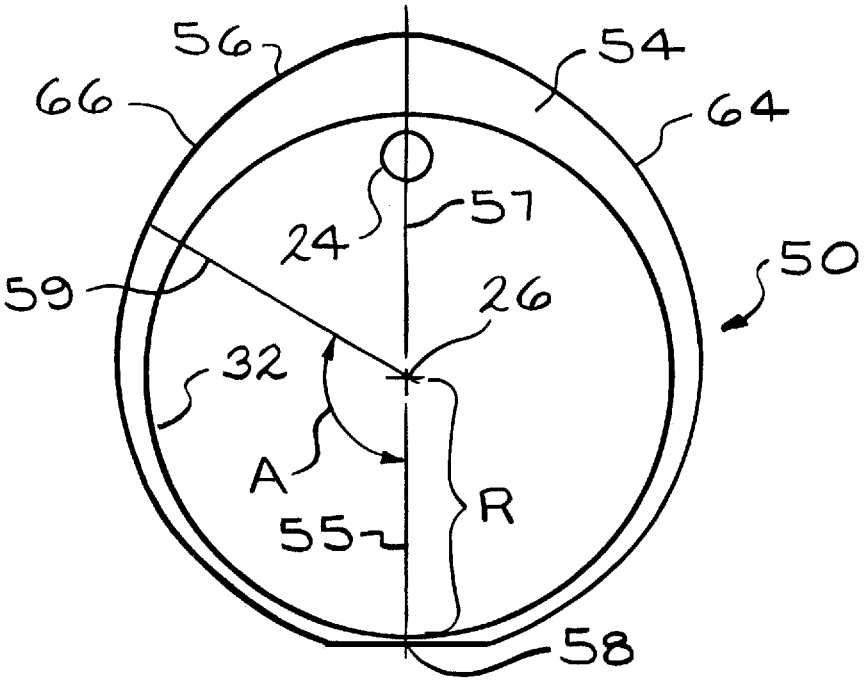
FIG. 7 presents an alternate embodiment cup lid wherein the circumscribing roll flange is, generally, cam shaped and includes a small flat area, or land, diametrically opposite the lid's fluid discharge opening.
Figure 7A:
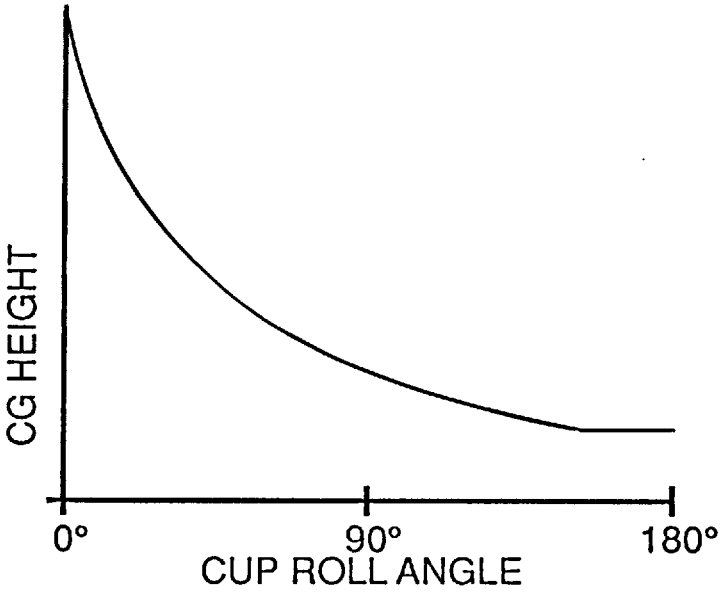
FIG. 7A presents the liquid center of gravity height versus cup roll angle for the lid roll flange embodiment as illustrated in FIG. 7.

Still further a roll flange 54 might be configured as illustrated in FIG. 7 having a flat portion 58 whereby the cup assembly 50 would become dynamically stable upon rolling on to the flat portion 58. A representative center of gravity height vs. roll angle curve might be as illustrated in FIG. 7A wherein a larger negative slope (representing a higher center of gravity induced roll rate) might be programmed into the rim flange 54 to reposition the opening 24 from the six o'clock position to the 12 o'clock position. Such a modified roll flange may have a cam shaped periphery 56 as illustrated in FIG. 7.

The cam shaped profile or periphery 56 of flange 54, as illustrated in FIG. 7, is symetrical about the reference, or zero degree, radial 55 and the 180 degree radial 57. The length, or radius R, of each radial 59, from the zero degree radial 55 to the 180 degree radial 57 is a mathematical function of angle A as measured from the zero degree radial with the zero degree radial 55 being having the shortest length R and the 180 degree radial 57 having the longest length R. Opening 24 is preferably placed on the 180 degree radial as illustrated.

As an alternate embodiment to the above teaching whereby an otherwise circular cup lid is configured with a circumscribing, eccentricly configured, roll flange, it is also within the present invention to provide an eccentricaly configured cup lid having a circumscribing periphery that will cause the desired center of gravity induced roll of the lid-cup assembly. Such a cup lid may be provided with an eccentricily configured cup sealing groove 32 (see FIG. 6) such that when the lid is placed upon the cup, the otherwise circular cup bead 35 would be deformed and reconfigured to the lid profile as the cup bead is inserted into the lid's sealing groove 32.

Although the invention as taught herein above is disclosed in the form of a typical fast food drinking cup, the invention is also, and possibly more suitable, for application to other liquid containers such as metal or plastic barrels typically used to contain environmentally damaging liquids. Therefore the teaching herein is to be understood as applying to any and all liquid containers.

Figure 8:
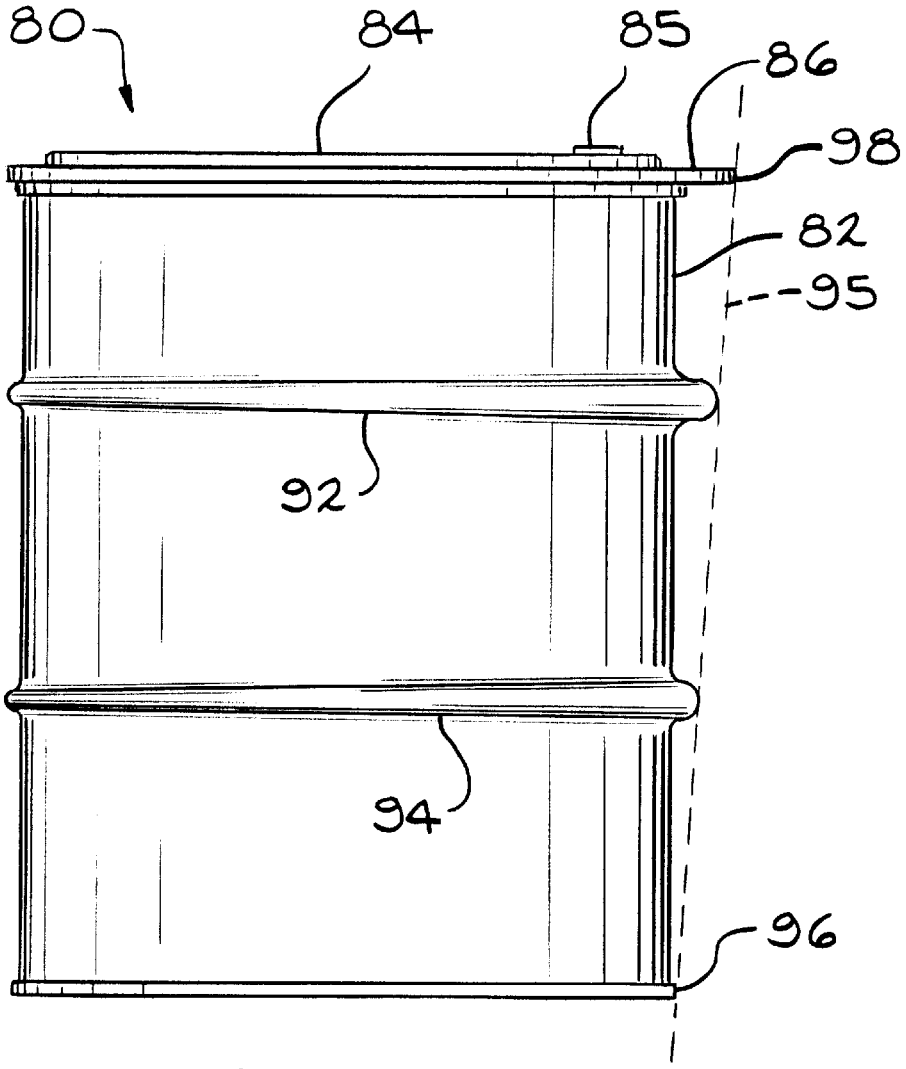
FIG. 8 presents an elevational view illustrating a typical fifty five gallon drum embodying the present invention.

For example, FIG. 8 illustrates a typical fifty five gallon drum, typically used to transport petrochemical products, embodying our invention. Drum assembly 80 generally comprises a cylindrical drum 82 having either a removable, or integral, top lid 84. Top lid 84 is provided an eccentric, circular roll flange 86, similar to that as taught above in FIGS. 1 and 2, projecting radially outward from the outside surface of drum 82. Bung hole 85, or any other suitable fluid discharge opening, is located adjacent roll flange 86, similar to the opening 24 as illustrated in FIG. 2. It is believed preferable, for drum 82 to be further provided with eccentric intermediate circumscribing flanges or ribs 92 and 94 to share in supporting the weight of drum assembly 80 when drum assembly 80 is in the prone position. The degree of eccentricity of ribs 92 and 94 is determined by drawing an imaginary line 95 from the bottom peripheral surface 96 to the outer peripheral surface 98 of roll flange 86. Drum assembly may be constructed of steel or any other material suitable for the end use of the container.

Having described the preferred embodiments of the present invention, and several of its benefits and advantages, it will be understood by those of ordinary skill in the art that the foregoing description is merely for the purpose of illustration and that numerous substitutions, rearrangements, modifications and applications may be made in the invention without departing from the scope and spirit of the appended claims.

We claim:

1. In a liquid container having a generally cylindrical configuration wherein said container includes a generally cylindrical side wall, and an enclosing bottom and top wall, the improvement wherein said top wall includes a periphery, circumscribing said top wall, and projecting outward from and beyond said top wall by a radial distance d wherein said distance d varies as a function of angular position from a chosen reference point on the periphery of said top wall.

2. The liquid container as claimed in claim 1 wherein said top wall is removable.

3. The liquid container as claimed in claim 2 wherein said container is a drinking cup.

4. The liquid container as claimed in claim 1 wherein said top wall includes an opening for removal of liquid from within said container, said opening being positioned adjacent said periphery where the dimension d is largest.

5. The container as claimed in claim 1 wherein the dimension d is minimal at a first selected radial of said container and increasing to a maximum at a second radial of said container, said second radial being angularly displaced 180 degrees from said first radial.

6. The container as claimed in claim 1 wherein the outer circumference of said periphery comprises a circle wherein the center of said circle is eccentric to the axial center line of said cylindrical container.

7. The container as claimed in claim 1 wherein said flange includes reinforcement means for rigidifying said flange.

8. The container as claimed in claim 1 wherein said side wall comprises a truncated cone.

9. The container as claimed in claim 1 wheren said top wall periphery includes a flat portion where the distance d is smallest.

10. A container comprising:

a) a generally cylindrical wall, and having an enclosing bottom wall and an open top, b) a cover for enclosing said open top, c) at least one flange circumscribing and extending radially outward from the outer peripheral surface of said cylindrical wall by a radial distance d, wherein said distance d varies as a function of the angular position from a chosen point on the periphery of said peripheral surface.

11. The container as claimed in claim 10 wherein the dimension d is minimal at a first selected radial of said container and increasing to a maximum at a second radial of said container, said second radial being angularly displaced 180 degrees from said first radial.

12. The container as claimed in claim 11 wherein said cover includes an opening therein for the removal of the contents from within said container, said opening being positioned adjacent said cylindrical wall and on said second radial.

13. The container as claimed in claim 10 wherein the outer circumference of said flange comprises a circle wherein the center of said circle is eccentric to the axial center line of said cylindrical container.

14. A barrel comprising:

a) a generally cylindrical wall, and an enclosing bottom and top wall, c) a flange circumscribing and extending radially outward from the outer peripheral surface of said cylindrical wall by a radial distance d, wherein said distance d varies as a function of the angular position from a chosen point on the periphery of said cylindrical wall, said flange axially positioned near said top wall.

15. The barrel as claimed in claim 14 wherein the dimension d is minimal at a first selected radial of said container and increasing to a maximum at a second radial of said container, said second radial being angularly displaced 180 degrees from said first radial.

16. The barrel as claimed in claim 15 wherein said top wall includes an opening therein for the removal of the contents from within said container, said opening being positioned adjacent said cylindrical wall and on said second radial.

17. The barrel as claimed in claim 15 wherein the outer circumference of said flange comprises a circle wherein the center of said circle is eccentric to the axial center line of said barrel.

18. The barrel as claimed in claim 14 wherein said flange is integral with said top wall.

19. The barrel as claimed in claim 18 wherein one or more additional flanges are axially positioned between said top wall and said bottom wall, said additional flanges having an outer periphery extending to an imaginary line extending from the outer periphery of said bottom wall to the outer periphery of said top wall flange.

20. The barrel as claimed in claim 14 wherein said flange includes reinforcement means for rigidifying said flange.

21. In a drinking cup assembly having a generally cylindrical side wall, an enclosing bottom wall, and a removable lid, the improvement wherein said lid includes a peripheral flange, circumscribing said lid, and projecting outward from and beyond said top lid by a radial distance d wherein said distance d varies as a function of angular position from a chosen reference point on the periphery of said lid.

22. The drinking cup as claimed in claim 21 wherein the dimension d is minimal at a first selected radial of said lid and increasing to a maximum at a second radial of said lid, said second radial being angularly displaced 180 degrees from said first radial.

23. The drinking cup as claimed in claim 22 wherein said lid includes an opening therein for the removal of the contents from within said cup, said opening being positioned adjacent said cylindrical wall and on said second radial.

24. The drinking cup as claimed in claim 23 wherein the outer periphery of said flange comprises a circle wherein the center of said circle is eccentric to the axial center line of said cup.

25. The drinking cup as claimed in claim 23 wherein said flange includes reinforcement means for rigidifying said flange.

26. The drinking cup as claimed in claim 25 wherein said reinforcement means comprises a at least one radially extending rib embossed within the surface of said flange and projecting outward therefrom.

27. The drinking cup as claimed in claim 25 wherein said reinforcing means comprises a multiplicity of radially extending flutes within said flange.

* * * * *